US006059306A

United States Patent [19]

Metrot et al.

[11] Patent Number: 6,059,306

[45] Date of Patent: May 9, 2000

[54] GLIDE BOARD INTENDED FOR SNOWBOARDING

[75] Inventors: Eric Metrot, Mossman Park, Australia; Thierry Marion, Duingt, France

[73] Assignee: Salomon S.A., Metz-Tessy, France

[21] Appl. No.: 09/012,730

[22] Filed: Jan. 23, 1998

[30] Foreign Application Priority Data

Jan. 24, 1997 [FR] France ..... 97 01188

[51] Int. Cl.[7] ..... A63C 5/07

[52] U.S. Cl. ..... 280/602; 280/609; 280/14.2

[58] Field of Search ..... 280/14.2, 602, 280/607, 609, 610, 11.12; 441/68

[56] References Cited

U.S. PATENT DOCUMENTS

| | | | |
|---|---|---|---|
| 4,592,567 | 6/1986 | Sartor | 280/602 |
| 4,679,813 | 7/1987 | Girard | 280/602 |
| 5,464,358 | 11/1995 | Unger et al. | 280/609 |
| 5,573,264 | 11/1996 | Deville et al. | 280/602 |
| 5,782,482 | 7/1998 | Andrus et al. | 280/14.2 |
| 5,855,389 | 1/1999 | Andrus et al. | 280/14.2 |
| 5,984,343 | 11/1999 | Longoni et al. | 280/602 |

FOREIGN PATENT DOCUMENTS

| | | | |
|---|---|---|---|
| 218196 | 4/1987 | European Pat. Off. | 280/602 |
| 2702386 | 9/1994 | France | 280/602 |
| 2703257 | 10/1994 | France . | |
| 2729086 | 7/1996 | France . | |
| 3403828 | 8/1984 | Germany | 280/602 |
| 3919010 | 4/1992 | Germany . | |
| 4207768 | 9/1993 | Germany . | |
| 297 06 716 U | 7/1997 | Germany . | |

*Primary Examiner*—J. J. Swann
*Assistant Examiner*—F. B. Vanaman
*Attorney, Agent, or Firm*—Greenblum & Bernstein P.L.C.

[57] ABSTRACT

A gliding board for use in snowboarding. The board includes two off-centered portions located on either side of a central portion or middle sole along a longitudinal axis of the board. At least one off-centered portion of the board includes at least one reinforcement that provides the off-centered portion with a greater mechanical resistance during torsion, along the longitudinal axis, than the mechanical resistance during torsion of the middle sole along the same longitudinal axis.

25 Claims, 2 Drawing Sheets

D1
IV
VI
X1
B1
E1
I4
F1
F
II
1
2
I3
F2
E2
B3
D2
X2
6
4
7
X4
B2
M1
I1
VI
IV
3
II
W
I2
M2
B4
X3
5
L

III
III
6
F
8
11
3
1
2
10
13
12
7
9
14

W
C
G
L
G
8
C

GLIDE BOARD INTENDED FOR SNOWBOARDING

BACKGROUND OF THE INVENTION

1. Field of the Invention

The instant invention is related to the field of glide boards. It is especially related to a board intended to be used for snowboarding.

2. Description of Background and Relevant Information

A user steers a board intended for snowboarding, or a snowboard, with both legs that are retained on the board in a substantially transverse direction with respect to the length of the board.

The user, or rider, must be able to control his/her path, especially in extreme situations, such as in turns or prior to jumps, which require a substantial support in the area of the contact lines of the board on the snow.

In order to do this, it is necessary that the board be relatively flexible in its lengthwise direction, and relatively stiff in the direction of its width. Longitudinal bending flexibility along a substantially transverse axis allows for a good control of the trajectory during turns. Transverse stiffness along a longitudinal axis allows for the transmission of the steering forces towards the ends of the board, and avoids the transverse bending of the board in case it comes into abrupt contact with bumps on the terrain.

Prior art documents have disclosed numerous boards having a variety of structures in order to fulfill these criteria.

In particular, the French document FR 2 703 257 B1 discloses a board comprising a central platform that is extended in the direction of the tip and tail by the creation of ribs. The platform is located in the middle sole zone and receives bindings enabling the user to be retained thereupon.

However, the board described in the French document FR 2 703 257 B1 has a certain number of disadvantages.

Firstly, the board is stiff in its lengthwise direction due to the presence of the platform, and thus does not enable good steering control while talking curves.

Secondly, in the area of the middle sole, the board displays a substantial thickness over its entire width, which provides it with substantial torsional resistance in this area with respect to the other parts of the board. As a result, the ends of the board get more deformed than the middle sole, and control of the path or trajectory prior to jumping is not appropriate.

The platform extends beyond the middle sole towards the tip and tail, thus substantially increasing the mass of the board, and this negatively impacts ease of steering and responsiveness.

The structure of the board is such that the user must keep his/her feet on the platform, whose function is to increase the stiffness of the board, which reduces the amplitude of the sensations perceived by the rider. Once again, steering becomes less precise.

SUMMARY OF THE INVENTION

It is an object of the instant invention to overcome the disadvantages listed above as well as many other disadvantages.

To this end, the invention proposes a glide board intended to be used for snowboarding, the board comprising two off-centered portions located on either side of a central portion or middle sole along a longitudinal axis of the board.

At least one off-centered portion of the board comprises at least one reinforcement means which confers to the off-centered portion a greater mechanical resistance during torsion, along the longitudinal axis, than the mechanical resistance during torsion of the middle sole along the same longitudinal axis.

As a result, the board advantageously allows the user to be well-supported during turns or prior to jumps along with a good control over the steering trajectory.

According to the invention, the middle sole is juxtaposed to each off-centered portion, the middle sole being intended to receive the retention devices of the user's boots on a support surface of the board, each off-centered portion comprising a contact line with the ground on the glide surface of the board that is opposite the support surface.

This structure enhances the amplitude of the sensations perceived by the user, thus resulting advantageously in a more precise steering.

Also according to the invention, the reinforcement means extend substantially between the contact line and the middle sole, thus allowing flexibility to be retained at the level of the middle sole, which results in good steering control while taking curves.

In addition, according to the invention, the reinforcement means comprises at least one strip forming an angle that is greater than zero with respect to the longitudinal axis. The orientation of the strip allows one to choose a direction of resistance to the deformation of the off-centered portion.

Preferably, the strip extends substantially from the contact line near a first lateral edge of the board, up to the middle sole near a second lateral edge of the board, opposite the first edge. In this way, resistance during torsion is maximized.

Preferably once again, according to the invention, the strip comprises fibers made of composite materials that are oriented in the length-wise direction of the strip. Its manufacture is simple and the mechanical resistance of the strip can be pre-determined by selecting the nature and number of the fibers.

The off-centered portion, according to the invention, comprises four strips forming two, two-strip crosses, one cross being located substantially at the level of the support surface and the other cross being located substantially at the level of the glide surface.

The reinforcement means are therefore located substantially on each side of the thickness of the board, and this provides it with greater resistance to deformation.

Preferably, each off-centered portion comprises two crosses. An advantageous result thereof is that the user's steering improves regardless of the direction in which he moves.

Furthermore, according to the invention, one cross is located in the area of the support surface towards the outside of the board, and the other cross is located in the area of the glide surface towards the inside of the board.

This arrangement provides maximum torsional resistance for a given board weight and for a given strip orientation.

Finally, each strip is oriented substantially at 45° with respect to the longitudinal axis.

This angle value is the value that provides the best torsional resistance for the off-centered portion.

BRIEF DESCRIPTION OF THE DRAWINGS

Other characteristics and advantages of the invention will be better understood with the help of the following description and with respect to the annexed drawings that illustrate, via non-restrictive embodiments, how the invention can be obtained, and wherein.

DETAILED DESCRIPTION OF THE INVENTION

Figure 1:
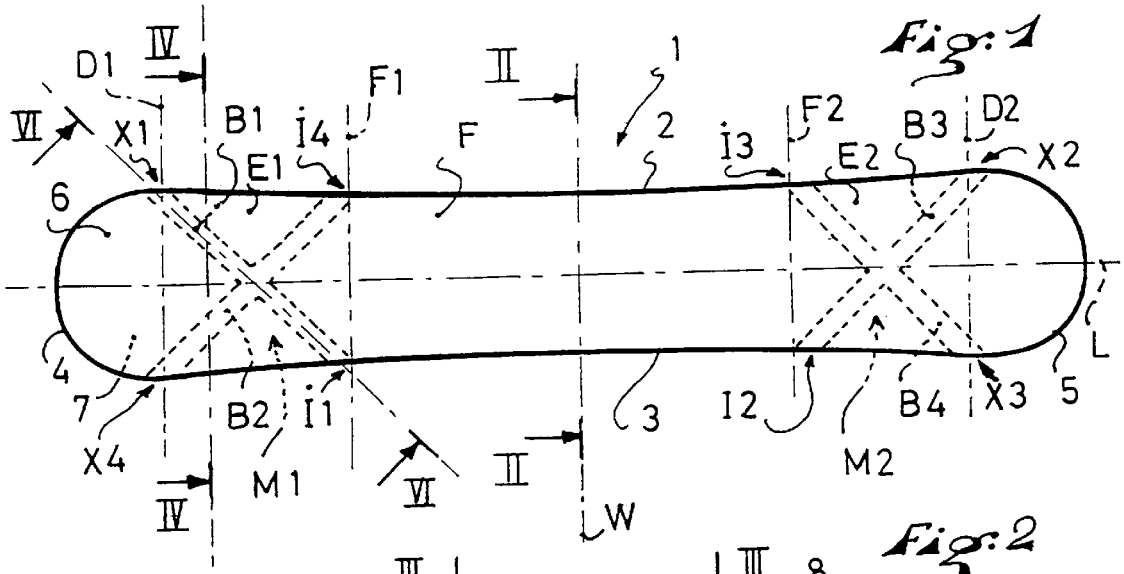
FIG. 1 is a top view of a board according to the invention.

FIG. 1 schematically represents, in a top view, a glide board 1 that corresponds to several embodiments.

Board 1, demarcated by the lateral edges 2, 3 and the ends 4, 5, extends substantially along a longitudinal axis L.

Board 1 preferably displays a symmetry in its lateral edges 2, 3 with respect to the longitudinal axis L, which in this case is a median axis of the board 1. But it should be understood that any other shape for edges 2, 3 could be used, with or without a symmetry for the edges 2, 3.

Similarly, the ends 4, 5 of board 1 each display a shape that is rounded towards the outside and provide, to board 1, a symmetry with respect to the transverse axis W, which is perpendicular to the axis L and located substantially at the center of the board 1, between the ends 4, 5. Any other shape for the ends 4, 5 could be appropriate, which could make the board 1, for example, asymmetrical with respect to the axis W.

The general shape of the board 1 according to the preferred embodiments advantageously allows for a steering that is easy in either direction along the length of the board 1.

A support surface 6 of board 1, demarcated by the edges 2, 3 and the ends 4, 5, is intended to receive means for retaining a user's feet. These retention means are known to persons of the art, and they are connected to board 1 by any means in an intermediate portion F, or middle sole, demarcated in FIG. 1 by the axis lines F1, F2. Preferably, the middle sole F extends along the surface 6 between the lines F1, F2 such that the distance between F1 and W is substantially equal to the distance between W and F2. As a result, the middle sole F is a part of the board 1 that is substantially symmetrical with respect to the axis W.

The middle sole F has a size such that any user can position the foot retention means as it suits him best. In particular, the middle sole F is long enough in the direction of the longitudinal axis L so that the feet are retained on the middle sole F regardless of the user's size or steering style.

Figure 2:
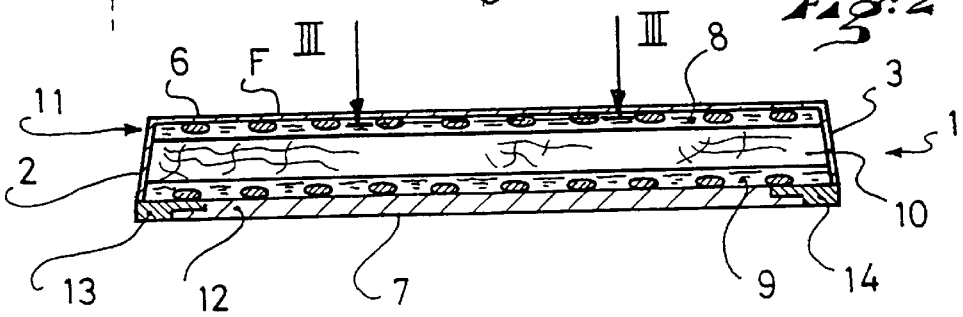
FIG. 2 is a cross section taken along line II—II of FIG. 1.

As has been represented in FIG. 2, the board 1 comprises a glide surface 7 that is located opposite the support surface 6 with respect to the thickness of the board 1.

The inner structure of the board 1, represented in FIG. 2, is one potential embodiment of the invention which in no way limits the object of the invention. Preferably, board 1 comprises two layers 8, 9 made of composite materials impregnated with thermohardenable resins located on either side of a core 10, made of wood, foam of a plastic material or other; the layer 8 is located so as to be in contact with the core on the side of the support surface 6, whereas the layer 9 is located so as to be in contact with the core on the side of the glide surface 7. A decorative layer 11 is added at the level of the edges 2, 3 and the support surface 6, whereas the glide surface 7 comprises a sole 12, for example, made of polyethylene, and running edges 13, 14, for example, made of a steel alloy.

The elements of the inner structure of the board 1 as shown in FIG. 2 are distributed substantially along the entire board 1.

Figure 3:
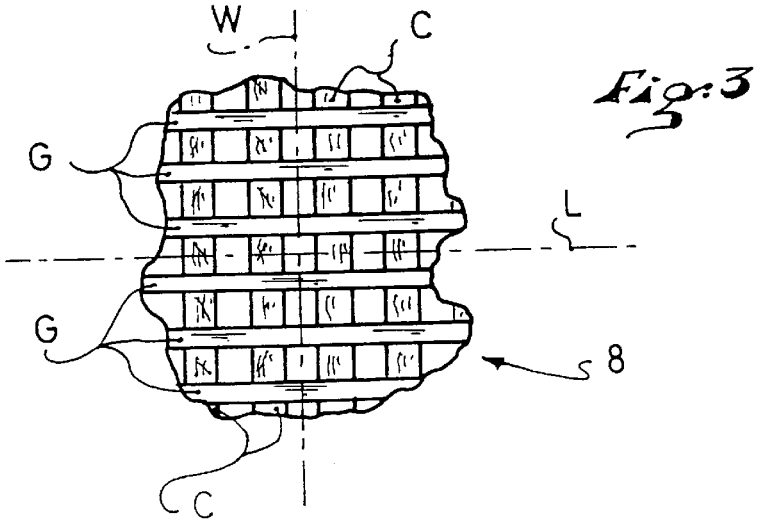
FIG. 3 is a partial cross section taken along line III—III of FIG. 2.

As has been represented by the section of FIG. 3, the layer 8 made of composite materials is preferably a grid which comprises glass fibers G and carbon fibers C.

The glass fibers G are oriented substantially along the direction of the longitudinal axis L of board 1, whereas the carbon fibers C are oriented substantially along the direction of the transverse axis W of board 1.

Similarly, layer 9 made of composite materials comprises glass fibers G and carbon fibers C that are oriented in the same way as in layer 8.

Preferably, the glass fibers G of the layers 8, 9 extend along the entire length of board 1, and the carbon fibers C extend along the entire width of board 1.

The structure described hereinabove makes board 1 relatively flexible in its length-wise direction, and relatively stiff in the direction of its width.

The longitudinal flexibility allows the user to bend the board 1 while negotiating turns, or while providing impulsions in order to execute jumps or figures, whereas the lateral stiffness allows the user to transmit the steering forces towards the ends 4, 5 of board 1. More specifically, the steering forces act on the ground at the level of the contact lines D1, D2 of the glide surface 7. Each contact line D1, D2 is a part of the curved surface of sole 7 which extends transversely with respect to the length of board 1, and which projects from surface 7 in order to touch the ground.

As has been shown in FIG. 1, the contact line D1 is located at the widest part of board 1 between the limits F1 of the middle sole F and the end 4, and the contact line D2 is located at the widest part between the limit F2 and the end 5.

Any part of the sole 12 can touch the ground, but it should be understood that the four points X1, X2, X3, X4 of sole 12, which respectively correspond to the intersection of a contact line D1, D2 with an edge 2, 3, are the preferred points of contact. It is at the points X1, X2, X3, X4 that the greatest steering forces are transmitted to the ground, or where the greatest impacts are transmitted to the board 1 after a jump or a figure.

In FIG. 1, two dotted and dashed parts shaped like a cross schematically represent the reinforcement means M1, M2 that are added to the structure of the board. The reinforcement means M1, M2 are respectively located in an off-centered portion E1 demarcated by the contact line D1 and the limit F1 of middle sole F, and in an off-centered portion E2 demarcated by the contact line D2 and the limit F2 of middle sole F.

The reinforcement means M1 comprises an arm B1 that extends substantially between the point X1 and an intersection point I1 of edge 3 and of the limit F1 of middle sole F, as well as an arm B2 between the point X4 and an intersection point I4 of edge 2 and of the limit F1.

Similarly, the reinforcement means M2 comprises an arm B3 that extends substantially between the point X2 and an intersection point I2 of edge 3 and of the limit F2 of middle sole F, as well as an arm B4 between the point X3 and an intersection point I3 of edge 2 and of the limit F2.

The reinforcement means M1, M2 are used to stiffen the portions E1, E2 during torsion with respect to a longitudinal axis such as L of board 1, such that the longitudinal bending characteristics of the board 1 remain substantially identical to the characteristics obtained with the structure described with the help of FIG. 2. In other words, this means that board 1 retains the same flexibility during bending along its length despite the presence of the reinforcement means M1, M2. Simply, the torsional resistance of board 1 is increased in a localized manner in the off-centered portions E1, E2.

Figure 4:
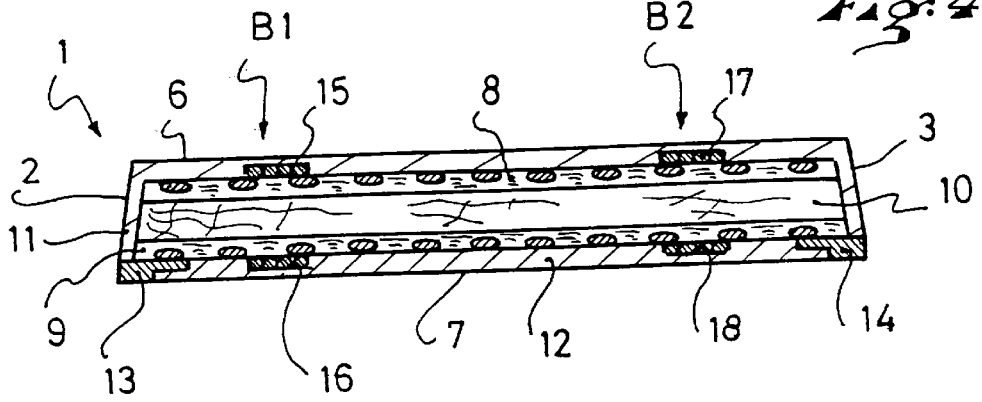
FIG. 4 is a cross section taken along line IV—IV of FIG. 1 according to an alternate embodiment.
Figure 5:
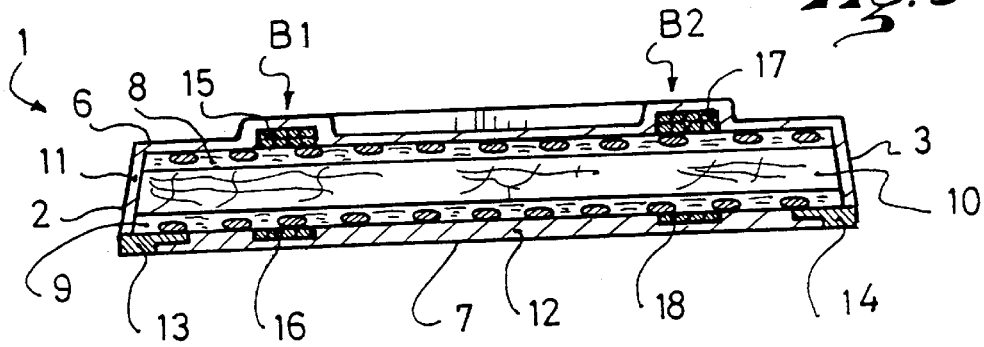
FIG. 5 is similar to FIG. 4 but corresponds to another embodiment.
Figure 6:
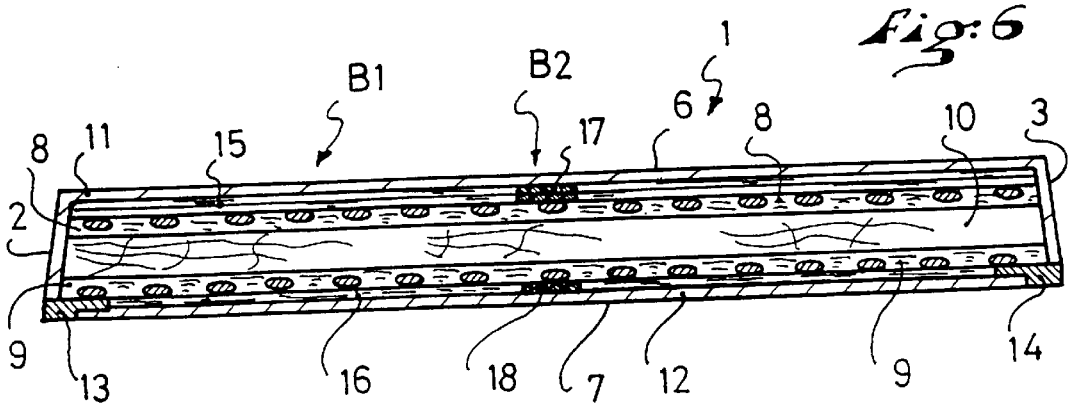
FIG. 6 is a cross section taken along line VI—VI of FIG. 1.

Examples of the reinforcement means are represented sectionally in FIGS. 4, 5, and 6.

FIG. 4 represents the inner structure of the board 1 described with the help of FIG. 2 to which the reinforcement means M1 have been added. More specifically, the arm B1 comprises a strip of material, or strip, made of composite materials 15 that is placed in contact with the layer 8, and a strip of composite materials 16 is placed in contact with the layer 9, in a groove of sole 12.

Similarly, the arm B2 comprises a strip made of composite materials 17 that is placed in contact with the layer 8, and a strip of composite materials 18 is placed in contact with the layer 9, in another groove of sole 12.

The strips 15, 16, 17, 18 of the arms B1, B2 are respectively distributed as close as possible to the support surface 6 or the glide surface 7, so as to provide the board 1 with the greatest possible torsional resistance in the off-centered portions E1, E2.

The strips 15, 16, 17, 18 are preferably obtained with carbon fibers that extend along the arms B1, B2 from one edge of the board 1 to the other, as is shown in FIG. 6.

Other materials such as aramide or glass fibers could also be considered appropriate.

FIG. 5 is a variation of the invention of FIG. 4. Identical elements have been designated with the same references and are not being described herein. The modification with respect to the embodiment of FIG. 2 consists of adding layers of composite materials so as to thicken the strips 15 and 17 of the arms B1 and B2. In this case, the reinforcement means M1 projects from the surface 6 of board 1.

Generally speaking, it should be understood that the arms B3, B4 are obtained in a manner similar to the arms B1, B2.

In all cases, an important characteristic of the embodiments of the invention consists of increasing the torsional stiffness of the off-centered portions E1, E2 with a negligible increase in the total mass of board 1. As a matter of fact, the strips 15, 16, 17, 18 are housed in the structure of board 1 in housings obtained in other layers.

And when a reinforcement means M1, M2 projects from surface 6, its thickness is relatively small. Consequently, the user can steer his board with greater intensity than would be the case with a board that is not equipped with the reinforcement strips.

The manufacture of board 1 according to the invention calls for materials and implementation techniques that are known to a person of the art.

The invention is not limited to the embodiments described herein, and it comprises all technical equivalents that could fall within the scope of the following claims.

In particular, one could provide for the use of all sorts of materials in order to obtain the strips of the reinforcement means M1, M2, as for example, metals or metallic alloys.

Furthermore, the strips can have different sizes, different widths and different thicknesses. They can also be constituted of several different materials. In addition, they can be arranged on any side of the layers 8, 9.

It could also be envisioned that the strips are different from one another so as to provide the board with an asymmetrical behavior.

Finally, the orientation of the strips with respect to the longitudinal axis of board 1 can be other than 45°.

What is claimed is:

1. A gliding board adapted for use in snowboarding comprising:

a front end, a rear end, and first and second opposite lateral side edges, said board extending along a longitudinal axis between said front and rear ends;

an intermediate portion positioned between said front and rear ends, said intermediate portion including an upper support surface, said upper support surface being adapted to receive boot retention devices;

two off-centered portions, each of said two off-centered portions being positioned between said intermediate portion and a respective one of said front and rear ends, said intermediate portion being juxtaposed to each of said two off-centered portions;

a glide surface on a side of the gliding board opposite said support surface, each of said two off-centered portions comprising a respective transversely extending contact line along said glide surface with respect to a ground surface;

at least one of said two off-centered portions comprising at least one strip of material providing said one of said two off-centered portions with a greater mechanical resistance during torsion about said longitudinal axis than a mechanical resistance during torsion about said longitudinal axis of said intermediate portion, said strip of material forming an angle greater than zero with respect to said longitudinal axis;

said strip of material extending from proximate one of said first and second lateral edges, substantially at one of said contact lines, to said intermediate portion proximate a second of said first and second lateral edges; and said intermediate portion comprising no strip of material forming an angle greater than zero with respect to said longitudinal axis.

2. A gliding board according to claim 1, wherein:

said strip of material comprises fibers made of composite materials oriented along a lengthwise direction of said strip of material.

3. A gliding board according to claim 1, wherein:

said at least one of said two off-centered portions comprises four of said strips, said four of said strips forming two crosses of two strips, one of said two crosses being located substantially at a level of said support surface, and a second of said two crosses being located substantially at a level of said glide surface.

4. A gliding board according to claim 3, wherein:

each of said two off-centered portions comprises two crosses.

5. A gliding board according to claim 4, wherein:

the one of said two crosses is located substantially in an area of said support surface towards an outside of the gliding board, and the second of said two crosses is located substantially at a level of the glide surface towards an inside of the gliding board.

6. A gliding board according to claim 1, wherein:

each of said strips of material is oriented substantially at 45° with respect to said longitudinal axis.

7. A gliding board according to claim 1, wherein:

said strip of material is fixedly connected to said board along a length of said strip of material.

8. A gliding board according to claim 1, wherein:

each of said at least one strip of material is fixedly connected to said board along a length of each of said at least one strip of material.

9. A gliding board according to claim 1, wherein:

said strip of material is made of carbon fibers.

10. A gliding board according to claim 1, wherein:

said strip of material is made of glass fibers.

11. A gliding board according to claim 1, wherein:

said strip of material is made of metal.

12. A gliding board according to claim 1, wherein:

said strip of material is made of metallic alloy.

13. A gliding board according to claim 1, wherein:

neither of said two off-centered portions have a viscoelastic material extending along any of said at least one strip of material.

14. A gliding board adapted for use in snowboarding comprising:

a front end, a rear end, and first and second opposite lateral side edges, said board extending along a longitudinal axis between said front and rear ends;

a middle sole positioned between said front and rear ends, said middle sole including an upper support surface, said upper support surface being adapted to receive boot retention devices;

two off-centered portions, each of said two off-centered portions being positioned on either side of said middle sole along the longitudinal axis, said middle sole being juxtaposed to each of said two off-centered portions;

a glide surface on a side of the gliding board opposite said support surface, each of said two off-centered portions comprising a respective transversely extending contact line along said glide surface with respect to a ground surface;

at least one of said two off-centered portions comprising at least one strip providing said one of said two off-centered portions with a greater mechanical resistance during torsion about said longitudinal axis than a mechanical resistance during torsion about said longitudinal axis of said middle sole, said strip forming an angle greater than zero with respect to said longitudinal axis;

said strip extending from proximate one of said first and second lateral edges, substantially at one of said contact lines, to said middle sole proximate a second of said first and second lateral edges; and said middle sole comprising no strip of material forming an angle greater than zero with respect to said longitudinal axis.

15. A gliding board according to claim 14, wherein:

each of said two off-centered portions having at least one strip providing each respective one of said two off-centered portions with a greater mechanical resistance during torsion about said longitudinal axis than a mechanical resistance during torsion about said longitudinal axis of said middle sole, each of said at least one strip forming an angle greater than zero with respect to said longitudinal axis.

16. A gliding board according to claim 14, wherein:

said strip comprises fibers made of composite materials oriented along a lengthwise direction of said strip.

17. A gliding board adapted for use in snowboarding comprising:

a front end, a rear end, and first and second opposite lateral side edges, said board extending along a longitudinal axis between said front and rear ends;

an intermediate portion positioned between said front and rear ends, said intermediate portion including an upper support surface, said upper support surface being adapted to receive boot retention devices;

two off-centered portions, each of said two off-centered portions being positioned between said intermediate portion and a respective one of said front and rear ends, said intermediate portion being juxtaposed to each of said two off-centered portions;

a glide surface on a side of the gliding board opposite said support surface, each of said two off-centered portions comprising a respective transversely extending contact line along said glide surface with respect to a ground surface;

at least one of said two off-centered portions comprising at least one mechanical resistance-increasing strip of material, each of said mechanical resistance-increasing strip of material comprising means for providing said at least one of said two off-centered portions with a greater mechanical resistance during torsion about said longitudinal axis than a mechanical resistance during torsion about said longitudinal axis of said intermediate portion, said strip of material forming an angle greater than zero with respect to said longitudinal axis;

said strip of material extending from proximate one of said first and second lateral edges, substantially at one of said contact lines, to said intermediate portion proximate a second of said first and second lateral edges; and said intermediate portion comprising no strip of material forming an angle greater than zero with respect to said longitudinal axis.

18. A gliding board according to claim 17, wherein:

said strip of material comprises fibers made of composite materials oriented along a lengthwise direction of said strip of material.

19. A gliding board according to claim 17, wherein:

said strip of material is fixedly connected to said board along a length of said strip of material.

20. A gliding board according to claim 17, wherein:

each of said at least one strip of material is fixedly connected to said board along a length of each of said at least one strip of material.

21. A gliding board according to claim 17, wherein:

said strip of material is made of carbon fibers.

22. A gliding board according to claim 17, wherein:

said strip of material is made of glass fibers.

23. A gliding board according to claim 17, wherein:

said strip of material is made of metal.

24. A gliding board according to claim 17, wherein:

said strip of material is made of metallic alloy.

25. A gliding board according to claim 17, wherein:

neither of said two off-centered portions have a viscoelastic material extending along any of said at least one strip of material.

* * * * *